US005729823A

United States Patent [19]

Gustafson et al.

[11] Patent Number: 5,729,823

[45] Date of Patent: Mar. 17, 1998

[54] CEMENTED CARBIDE WITH BINDER PHASE ENRICHED SURFACE ZONE

[75] Inventors: Per Gustafson, Huddinge; Leif Åkesson, Älvsjö, both of Sweden

[73] Assignee: Sandvik AB, Sandviken, Sweden

[21] Appl. No.: 616,095

[22] Filed: Mar. 14, 1996

[30] Foreign Application Priority Data

Apr. 12, 1995 [SE] Sweden ..... 9501383

[51] Int. Cl.[6] ..... B22F 3/00

[52] U.S. Cl. ..... 428/552; 428/697; 428/698; 428/699; 75/236; 75/238; 75/242; 419/11; 419/15; 419/26; 419/32; 419/38; 419/57; 51/307; 51/309; 51/295

[58] Field of Search ..... 428/547, 552, 428/697, 698, 699; 419/11, 14, 15, 26, 32, 38, 54, 57; 75/236, 238, 242; 51/307, 309, 295

[56] References Cited

U.S. PATENT DOCUMENTS

| | | | |
|---|---|---|---|
| 4,277,283 | 7/1981 | Tobioka et al. | 75/238 |
| 4,497,874 | 2/1985 | Hale | 428/551 |
| 4,548,786 | 10/1985 | Yohe | 419/29 |
| 4,610,931 | 9/1986 | Nemeth et al. | 428/547 |
| 4,830,930 | 5/1989 | Taniguchi et al. | 428/547 |
| 5,266,388 | 11/1993 | Anakkavur et al. | 428/212 |
| 5,451,469 | 9/1995 | Gustafson et al. . | |
| 5,484,468 | 1/1996 | Östlund et al. | 75/236 |

FOREIGN PATENT DOCUMENTS

| | | |
|---|---|---|
| 569 696 | 11/1993 | European Pat. Off. . |
| 92/05009 | 4/1994 | WIPO . |

OTHER PUBLICATIONS

Patent Abstracts of Japan, vol. 18, No. 666 (M-1724), 15 Dec. 1994 & JP 06 262307 A (Mitsubishi Materials Corp.), 20 Sep. 1994.

*Primary Examiner*—Ngoclan Mai
*Attorney, Agent, or Firm*—Burns, Doane, Swecker & Mathis, L.L.P.

[57] ABSTRACT

The present invention relates to a cemented carbide insert, comprising a cemented carbide substrate and a coating. The substrate contains WC and cubic carbonitride phase in a binder phase based of Co and/or Ni and has a binder phase enriched surface zone essentially free of cubic phase. The binder phase enriched surface zone prevails over the edge. As a result, an insert according to the invention has improved edge toughness and resistance against plastic deformation and is particularly useful for machining of sticky work piece materials such as stainless steel.

8 Claims, 2 Drawing Sheets

CEMENTED CARBIDE WITH BINDER PHASE ENRICHED SURFACE ZONE

BACKGROUND OF THE INVENTION

The present invention relates to coated cemented carbide inserts with unique edge security in sticky work piece materials such as stainless steel, achieved with a binder phase enriched surface zone extending over the edge.

Coated cemented carbide inserts with a binder phase enriched surface zone are today used to a great extent for the machining of steel and stainless materials. Thanks to the binder phase enriched surface zone, an extension of the application area for the cutting material has been obtained.

Methods to make cemented carbide containing WC, cubic phase (gamma-phase) and binder phase with binder phase enriched surface zones are known through a number of patents and published patent applications. According to, e.g., U.S. Pat. Nos. 4,277,283 and 4,610,931, nitrogen containing additions are used and sintering takes place in vacuum. According to U.S. Pat. No. 4,548,786, the nitrogen is added in the gas phase. In both cases, a binder phase enriched surface zone essentially free of cubic phase is obtained. U.S. Pat. No. 4,830,930 describes a binder phase enrichment obtained through decarburization after sintering whereby a binder phase enrichment is obtained which also contains cubic phase.

It is well-known in the art that the thickness of the binder phase enriched zone decreases towards sharp corners such as the cutting edge of an cutting insert, and that a brittle binder phase depleted zone, enriched in cubic phase, is present in the edge area and often limits the use of binder phase enriched cemented carbides especially in work piece materials with high demands on edge toughness.

However, the edges of a cutting insert have to be edge rounded to a certain radius of the order of 50–100 μm or less in order to be useful. The edge rounding is generally made after sintering by an edge rounding operation. In this operation, the thin outermost binder phase enriched zone is completely removed and the hard, brittle area is exposed. As a result, a hard but brittle edge is obtained resulting in an increased risk for problems with brittleness in the edge particularly in applications demanding high edge roughness.

One method of reducing this drawback of binder phase enriched sintered cemented carbides is described in U.S. Pat. No. 5,484,468. This method is, however, not sufficient in very difficult work piece materials such as austenitic stainless steel and may result in an unwanted decrease in the deformation resistance of the cutting insert.

A method of maintaining the binder phase enriched zone in the edge portion of a cemented carbide insert is disclosed in EP-A-0569696. According to this application, this effect is obtained if Zr and/or Hf is present in the cemented carbide.

OBJECTS AND SUMMARY OF THE INVENTION

It is an object of this invention to avoid or alleviate the problems of the prior art.

It is an object of the present invention to provide a cemented carbide insert with a combination of high edge toughness and high deformation resistance along with a method for making the same.

In one aspect of the invention there is provided a cutting insert for machining of sticky work piece materials such as stainless steel comprising a cemented carbide substrate with a binder phase enriched surface zone and a coating, said substrate comprising of a Co binder phase, WC and a cubic carbonitride phase of W and at least one of the metals Ti, Ta, Nb, Mo, V, or Cr, said binder phase enriched surface zone being essentially free of said cubic phase, the thickness of said binder phase enriched surface zone being 15–45 μm on a flat surface of said insert and 5–30 μm on the cutting edge.

In another aspect of the invention there is provided a method of making a cutting insert comprising a cemented carbide substrate with a binder phase enriched surface zone and a coating, said substrate comprising a binder phase of Co and/or Ni, WC and a cubic carbonitride phase, said binder phase enriched surface zone being essentially free of said cubic carbonitride phase and with an essentially constant thickness around the insert, comprising forming a powder mixture containing WC, 6–14 atom-% binder phase and 8–20 atom-% of Ti and at least one of Ta and Nb such that the Ti/(Ta+Nb) atomic ratio is >2, Ta and/or Nb being added as carbide and Ti as carbide, nitride and/or carbonitride in such proportions that the nitrogen content of the carbonitride phase expressed as x in the formula, (Ti,Nb,Ta)$(N_x,C_{1-x})$ is >0.2, adding to said powder mixture a pressing agent and carbon as necessary such that the carbon content is 0–0.15 weight-% above the stoichiometric content, milling and drying the mixture to obtain a powder material, compacting and sintering the powder material whereby between 1200° C. and sintering temperature, nitrogen gas is supplied to the furnace with a pressure of 5–100 mbar after which sintering as performed at a temperature of 1380°–1520° C. in vacuum or a protective atmosphere of 40 mbar argon for 1 hour, followed by cooling, and forming a hard, wear resistant coating of single or multiple layers of at lest one carbide, nitride, carbonitride, oxide or boride of at least one metal of the groups IVb, Vb and VIb of the periodic table and/or aluminum oxide.

DETAILED DESCRIPTION OF THE PREFERRED EMBODIMENTS OF THE INVENTION

Figure 1:
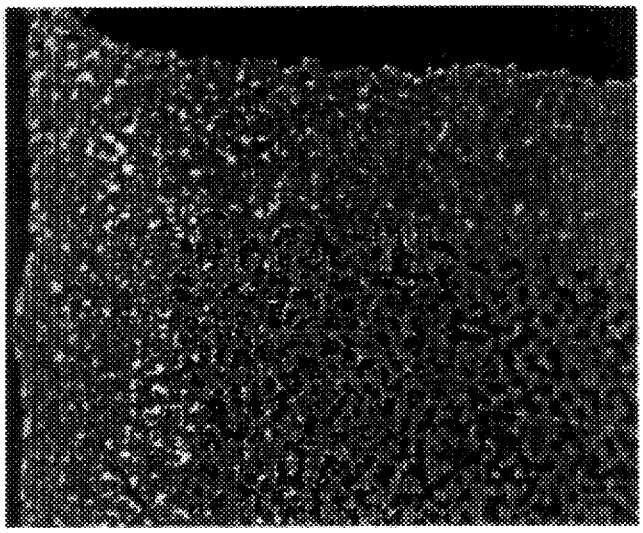
FIG. 1 shows in 800X the binder phase enriched zone under the cutting edge prior to edge rounding treatment of a cemented carbide according to the invention.

According to the presently claimed invention there is provided a cemented carbide insert comprising a cemented carbide substrate and a coating. The substrate contains WC and cubic carbonitride phase in a binder phase based on Co and/or Ni and has a binder phase enriched surface zone essentially free of cubic phase. The binder phase enriched surface zone prevails over the edge. As a result, an insert according to the invention has improved edge toughness and resistance against plastic deformation and is particularly useful for machining of sticky work piece materials such as stainless steel. (Although the cubic phase is essentially a carbonitride phase, the material is herein referred to as a cemented carbide.)

It has now surprisingly been found that the thickness of the binder phase enriched surface zone can be maintained over the edge also in cemented carbide free of Hf and Zr if certain conditions are fulfilled particularly with regard to the titanium and nitrogen content within the cubic phase as well as the overall carbon content. A favorable influence on the edge toughness in sticky materials such as austenitic stainless steel can be obtained.

The present invention relates to a cutting insert comprising a cemented carbide substrate with a binder phase enriched surface zone and a coating, said substrate consisting of a binder phase of Co and/or Ni, WC and a cubic carbonitride of W and at least one of the metals Ti, Ta, Nb, Mo, V or Cr with a binder phase enriched surface zone being essentially free of cubic phase.

Preferably, the cemented carbide contains 6–14 atom-%, preferably 8–11 atom-%, binder phase, 8–20 atom-%, preferably 11–17 atom-%, of Ti and at least one of Ta and Nb and the rest WC. The optimum average WC grain size shall be between 1.5 and 4 μm, preferably between 2 and 3 μm. The Ti/(Ta+Nb) atomic ratio in the cubic carbonitride phase shall be >2, preferably >3, with a nitrogen content expressed as x in the formula, (Ti,Nb,Ta) $(N_xC_{1-x})$ shall be >0.2, preferably between 0.3 and 0.4. The depth of the binder phase enriched surface zone close to the edge increases with increased titanium and nitrogen content within the cubic phase and with increased overall carbon content. The maximum nitrogen content that can be used in practice is mainly limited by the increased tendency for A and B type of porosity with increased nitrogen content. However, the maximum nitrogen content can be extended over the above stated limit if the sintering is performed in an inert atmosphere under high pressure. The maximum carbon content that can be used in practice is mainly limited by an increased tendency for carbon precipitation in the binder phase enriched surface zone, reduced coating adhesion and reduced deformation resistance. The carbon content shall correspond to a C-porosity lower than C08, preferably C00 just below carbon saturation.

The thickness of the binder phase enriched surface zone shall be

- below a flat surface 15–45 μm, preferably 25–35 μm
- close to a sharp edge, before edge rounding 15–35 μm, preferably 25–35 μm
- at the edge after edge rounding 5–30 μm, preferably 10–25 μm.

Inserts according to the invention shall preferably have a coating of TiC, TiCN and/or TiN with a total coating thickness of 3–10 μm, preferably 4–8 μm, possibly in combination with an $Al_2O_3$ coating with a thickness of 1–4 μm, preferably 1.5–3 μm. Other coatings known in the art can also be used such as single or multiple layers of at least one carbide, nitride, carbonitride, oxide or boride of at least one metal of the groups IVb, Vb and VIb of the periodic table and/or aluminum oxide by known CVD-, PVD- or MT-CVD-methods.

The invention also relates to a method of making cutting inserts comprising a cemented carbide substrate comprising of a binder phase of Co and/or Ni, WC and a cubic carbonitride phase with a binder phase enriched surface zone essentially free of cubic phase and a coating. A powder mixture containing WC, 6–14 atom-%, preferably 8–11 atom-% binder phase and 8–20 atom-%, preferably 11–17 atom-% of Ti and at least one of Ta and Nb such that the Ti/(Ta+Nb) atomic ratio is >2, preferably >3. Ta and/or Nb is/are added as carbides whereas Ti is added as TiC, TiCN and/or TiN in such proportions that the nitrogen content of the carbonitride phase expressed as x in the formula, (Ti, Nb,Ta) $(N_xC_{1-x})$ shall be >0.2, preferably 0.3–0.4. The powder mixture is mixed with a pressing agent and possibly carbon such that the carbon content is 0–0.15, preferably 0.05–0.1, weight-%, above the stoichiometric content and the mixture is milled and dried to obtain a powder material. Next, the powder material is compacted and sintered. During heating to sintering, nitrogen gas is supplied to the furnace at 5–100 mbar, preferably 10–40 mbar, in order to prevent denitrification prior to pore closure between 1200° C. and sintering temperature. Sintering is performed at a temperature of 1380°–1520° C., preferably 1410°–1450° C. in vacuum or a protective atmosphere of about 40 mbar argon for 1 hour. Cooling can be performed according to standard practice or as disclosed in U.S. Pat. No. 5,484,648. After convention post sintering treatments including edgerounding, a hard, wear resistant coating as described above is applied by CVD-, PVD- or MT-CVD-technique.

The invention is additionally illustrated in connection with the following Examples which are to be considered as illustrative of the present invention. It should be understood, however, that the invention is not limited to the specific details of the Examples.

EXAMPLE 1

From a powder mixture comprising 0.6 weight-% TiC, 3.5 weight-% Ti(C,N), 1.6 weight-% TaC, 1.1 weight-% NbC, 6.5 weight-% Co, and balance WC with 0.06 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to sintering temperature, 1450° C. The furnace was then evacuated and filled with Ar to 40 mbar for 1 h at 1450° C. and then cooled.

The structure in the surface of the cutting inserts consisted of a 30 μm thick binder phase enriched zone not only on the flank and rake faces but also the edge portions, FIG. 1.

Figure 2:
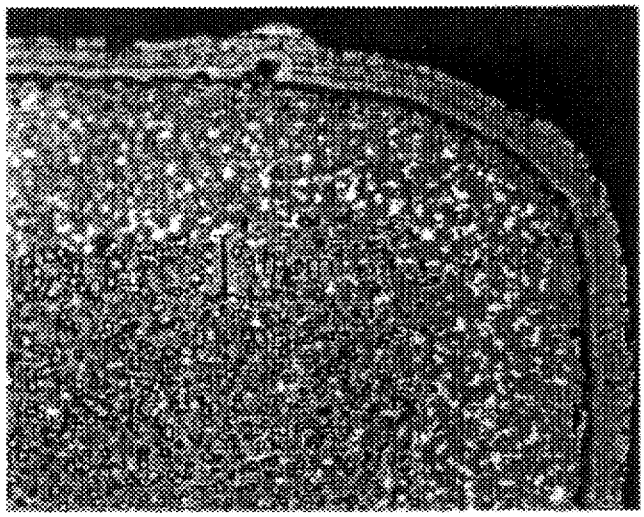
FIG. 2 shows in 800x the binder phase enriched zone under a cutting edge rounded to a 50 μm radius in a cemented carbide according to the invention.

After conventional edge rounding and cleaning, the cutting inserts were coated by conventional CVD-technique with an about 7 μm thick multiple coating consisting of TiC and TiCN, see FIG. 2.

EXAMPLE 2 (REFERENCE EXAMPLE TO EXAMPLE 1)

From a powder mixture comprising 1.6 weight -% TiC, 1.7 weight-% Ti(C,N), 2.1 weight-% NbC, 3.4 weight-% TaC, 6.5 weight-% Co, and balance WC with 0.06 weight-% overstoichiometric carbon content, turning inserts CNMG120408 were pressed. The inserts were sintered with $H_2$ up to 450° C. for dewaxing, further in vacuum to 1200° C., and after that with a protective gas of 40 mbar nitrogen up to sintering temperature, 1450° C., the furnace was then evacuated and filled with Ar to 40 mbar for 1 h at 1450° C. and then cooled.

Figure 3:
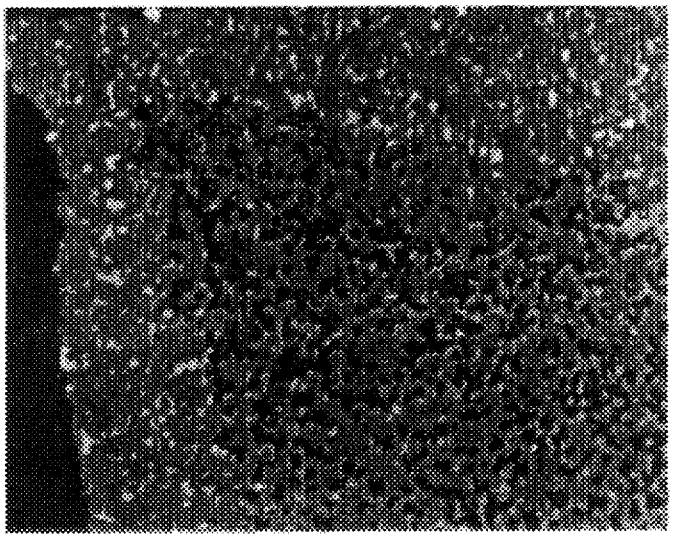
FIG. 3 shows in 1000X the binder phase enriched zone under the cutting edge prior to edge rounding treatment of a cemented carbide according to prior art.

The structure in the surface of the cutting inserts consisted of a 30 μm thick binder phase enriched zone under the flank and rake faces and a significantly reduced thickness of the binder phase enriched surface zone close to the edge portion of the inserts, FIG. 3.

Figure 4:
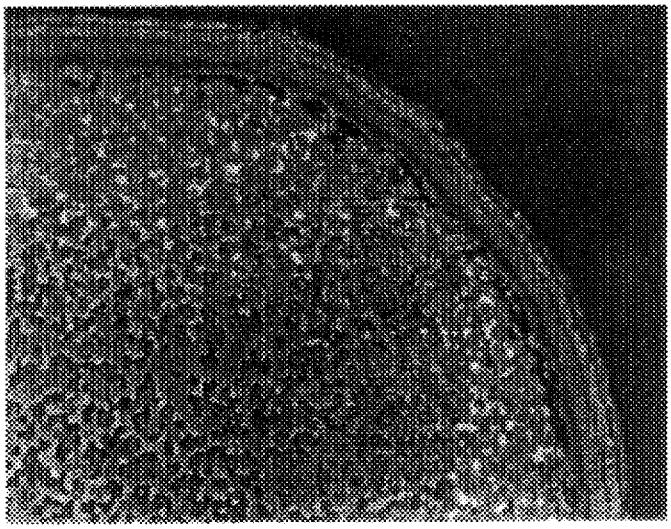
FIG. 4 shows in 1000X the binder phase enriched zone under a cutting edge rounded to a 50 μm radius in a cemented carbide according to prior art.

After conventional edge rounding and cleaning, the cutting inserts were coated by conventional CVD-technique with an about 7 μm thick layer consisting of TiC and TiN, see FIG. 4.

EXAMPLE 3 (REFERENCE EXAMPLE TO EXAMPLE 1)

From a powder mixture consisting of 2.6 weight % of TiC, 3.6 weight % TaC, 2.4 weight % of NbC, 6.5 weight % Co and the rest WC with 0.25 weight % overstoichiometric carbon content, turning inserts CNMG120408 were pressed. The inserts were sintered in $H_2$ up to 450° C. for dewaxing, further in a vacuum to 1350° C. and after that in Ar for 1 h at 1450° C. The cooling was performed with a well-controlled temperature decrease of 60° C./h. within the temperature interval 1290° C. to 1240° C. in the same atmosphere as during sintering. After that the cooling continued as normal furnace cooling with a maintained protective atmosphere. The binder phase enriched surface zone obtained as a result of this procedure consisted of a binder phase enrichment as a stratified binder phase structure extending to the surface and a sharp cobalt maximum of about 25 weight%.

EXAMPLE 4

The inserts from Examples 1, 2 and 3 were tested in a continuous facing operation in a thick-walled tube of tough-hardened steel with the hardness HB280. The following cutting data were used:

Speed: 300–450 m/min

Feed: 0.25 mm/rev

Cutting depth: 2 mm

The operation led to a plastic deformation of the cutting edge which could be observed as a flank wear on the clearance face of the insert. By repeated tests at increasing speed the speed resulting in a flank wear on 0.35 mm was determined with the following results:

| | Average speed |
|---|---|
| Example 1 (invention) | 420 m/min |
| Example 2 (known technique) | 410 m/min |
| Example 3 (known technique) | 350 m/min |

EXAMPLE 5

With the CNMG120408 inserts from Examples 1, 2 and 3, a test was performed as an combined longitudinal and facing operation is austenitic stainless steel. The following cutting data were used:

Speed: 200 m/min

Feed: 0.3 mm/rev

Cutting depth: 2 mm

The operation led to notch wear at the depth of cut and/or flank wear in the nose region. The number of cutting cycles to a flank wear or notch exceeding 0.3 mm was measured for five edges each with the following results:

| | Average tool life, cycles |
|---|---|
| Example 1 (invention) | 14 |
| Example 2 (known technique) | 9 |
| Example 3 (known technique) | 10 |

EXAMPLE 6

With the CNMG120408 inserts from Examples 1, 2 and 3 a test was performed as repeated facing operations in a stainless steel tube. The following cutting data were used:

Speed: 200 m/min

Feed: 0.2 mm/rev

Cutting Depth: 3 mm

The operation led to flank wear mainly induced by frittering of the edge. The time to a flank wear of 0.5 mm or edge fractures exceeding 0.5 mm was measured for five edges each with the following results:

| | Average Tool Life, min |
|---|---|
| Example 1 (invention) | 15 |
| Example 2 (known technique) | 4 |
| Example 3 (known technique) | 18 |

From Examples 4, 5 and 6, it is apparent that the inserts according to the invention, Example 1 combine the high deformation resistance that can be obtained with inserts according to known technique as described in Example 2 with the superior edge toughness that can be obtained with known techniques as described in Example 3. It is evident that a larger span in cutting properties and thereby application area can be obtained.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cutting insert for machining of sticky work piece materials comprising a cemented carbide substrate with a binder phase enriched surface zone and a coating, said substrate comprising 6–14 atom-% Co binder phase, WC and a cubic carbonitride phase of W, 8–20 atom-% of Ti and at least one of the metals Ta and Nb, such that the Ti/(Ta+Nb) atomic ratio is >2 and that the nitrogen content of the carbonitride phase expressed as x in the formula, (Ti, Nb, Ta) $(N_x, C_{1-x})$, is >0.2 said binder phase enriched surface zone being essentially free of said cubic phase, the thickness of said binder phase enriched surface zone being 15–45 μm on a flat surface of said insert and 5–30 μm on the cutting edge.

2. The cutting insert of claim 1 wherein the substrate comprises 11–17 atom-% of Ti and the Ti/(Ta+Nb) atomic ratio is >3.

3. The cutting insert of claim 1 wherein $0.3<x<0.4$.

4. The cutting insert of claim 1 wherein said coating comprises at least one of TiC TiCN or TiN with a total coating thickness of 3–10 μm.

5. A method of making a cutting insert comprising a cemented carbide substrate with a binder phase enriched surface zone and a coating, said substrate comprising a binder phase of Co and/or Ni, WC and a cubic carbonitride phase, said binder phase enriched surface zone being essentially free of said cubic carbonitride phase and with an essentially constant thickness around the insert, comprising forming a powder mixture containing WC, 6–14 atom-% binder phase and 8–20 atom-% of Ti and at least one of Ta and Nb such that the Ti/(Ta+Nb) atomic ratio is >2, Ta and/or Nb being added as carbide and Ti as carbide, nitride and/or carbonitride in such proportions that the nitrogen content of the carbonitride phase expressed as x in the formula, (Ti, Nb,Ta) $(N_x,C_{1-x})$ is >0.2, adding to said powder mixture a pressing agent and carbon as necessary such that the carbon content is 0–0.15 weight-% above the stoichiometric content, milling and drying the mixture to obtain a powder material, compacting and sintering the powder material whereby between 1200° C. and sintering temperature, nitrogen gas is supplied to the furnace with a pressure of 5–100 mbar after which sintering as performed at a temperature of 1380°–1520° C. in vacuum or a protective atmosphere of 40 mbar argon for 1 hour, followed by cooling, and forming a hard, wear resistant coating of single or multiple layers of at lest one carbide, nitride, carbonitride, oxide or boride of at least one metal of the groups IVb, Vb and VIb of the periodic table and/or aluminum oxide.

6. The method of claim 5 wherein said binder phase is 8–11 atom-% binder phase, Ti content is 11–17 atom-%, the Ti/(Ca+Nb) atomic ratio is >3, and the nitrogen content is 0.3–0.4.

7. The method of claim 5 wherein said nitrogen gas pressure is 10–40 mbar and the sintering temperature is 1410°–1450° C.

8. The cutting insert of claim 1 wherein said substrate also comprises Mo, V, Cr or mixtures thereof.

* * * * *